US008696284B2

(12) United States Patent
Aicher

(10) Patent No.: US 8,696,284 B2
(45) Date of Patent: Apr. 15, 2014

(54) THREADED ROD

(75) Inventor: Maximilian Aicher, Freilassing (DE)

(73) Assignee: Stahlwerk Annahutte Max Aicher GmbH & Co. KG, Hammerau (DE)

( * ) Notice: Subject to any disclaimer, the term of this patent is extended or adjusted under 35 U.S.C. 154(b) by 317 days.

(21) Appl. No.: 13/091,669

(22) Filed: Apr. 21, 2011

(65) Prior Publication Data

US 2011/0262246 A1 Oct. 27, 2011

(30) Foreign Application Priority Data

Apr. 23, 2010 (DE) ..... 20 2010 006 059 U

(51) Int. Cl.
*E04C 5/03* (2006.01)
*E21D 20/00* (2006.01)
*F16B 35/00* (2006.01)

(52) U.S. Cl.
USPC ..... 411/417; 411/411; 411/423; 405/259.1

(58) Field of Classification Search
USPC ..... 411/195, 411, 417, 418, 423, 424, 488; 405/259.1; 72/103
See application file for complete search history.

(56) References Cited

U.S. PATENT DOCUMENTS 206,078 A * 7/1878 Bowes ..... 52/157
357,768 A * 2/1887 Furbish ..... 470/11
1,048,590 A * 12/1912 Russell ..... 411/417
1,096,763 A * 5/1914 Smith ..... 81/160
1,327,934 A * 1/1920 Alcock ..... 408/239 R
1,376,945 A * 5/1921 Kristofek ..... 40/121
1,390,904 A * 9/1921 Hazelton ..... 74/424.78
1,973,170 A * 9/1934 Jacobi ..... 411/395
3,212,746 A * 10/1965 Wright ..... 410/77
3,561,185 A * 2/1971 Finsterwalder ..... 52/853
3,597,781 A * 8/1971 Eibes et al. ..... 470/10
3,670,795 A * 6/1972 Kupfrian ..... 411/195
3,866,510 A * 2/1975 Eibes et al. ..... 411/418
3,877,672 A * 4/1975 Wright ..... 248/503
RE28,907 E * 7/1976 Eibes et al. ..... 411/417
4,010,671 A * 3/1977 Hubbard et al. ..... 411/422
4,056,911 A * 11/1977 Tani ..... 52/851
4,112,637 A * 9/1978 Herbst ..... 52/155
4,179,976 A * 12/1979 Sygnator ..... 411/413
4,229,501 A * 10/1980 Kern ..... 428/399
4,630,971 A * 12/1986 Herbst et al. ..... 405/259.5
4,861,197 A * 8/1989 Calandra, Jr. ..... 405/259.3
4,877,463 A * 10/1989 Aicher et al. ..... 148/644
4,904,122 A * 2/1990 Herbst et al. ..... 405/259.1
5,234,236 A * 8/1993 Gromotka ..... 292/194
5,433,558 A * 7/1995 Gray ..... 405/259.1
5,775,850 A * 7/1998 Gale et al. ..... 405/259.5
5,803,671 A * 9/1998 Gray ..... 405/259.1
5,967,723 A * 10/1999 Duran ..... 411/121
6,309,159 B1 * 10/2001 Weaver et al. ..... 411/387.5
D496,471 S * 9/2004 Fergusson ..... D25/125
6,817,810 B2 * 11/2004 Jones ..... 405/252.1
6,860,688 B2 * 3/2005 Bushell et al. ..... 411/195
6,886,384 B2 * 5/2005 Gray ..... 72/103
7,478,986 B2 * 1/2009 Bushell et al. ..... 411/198

(Continued)

*Primary Examiner* — Victor Batson
*Assistant Examiner* — Tyler Johnson
(74) *Attorney, Agent, or Firm* — Morgan Lewis & Bockius LLP

(57) ABSTRACT

A threaded rod comprises a single coarse thread having flattenings on opposite sides forming thread sections on opposite sides. At least one of the thread sections on one side of the threaded rod is omitted.

17 Claims, 1 Drawing Sheet

(56) References Cited

U.S. PATENT DOCUMENTS

| | | | | |
|---|---|---|---|---|
| 7,624,556 | B2 * | 12/2009 | Plooksawasdi | 52/851 |
| 7,963,726 | B2 * | 6/2011 | Boot | 405/259.1 |
| 7,967,532 | B2 * | 6/2011 | Schmidt et al. | 405/259.1 |
| 2002/0192048 | A1 * | 12/2002 | Bushell et al. | 411/195 |
| 2005/0147482 | A1 * | 7/2005 | Bushell et al. | 411/195 |
| 2006/0115346 | A1 * | 6/2006 | Huang | 411/418 |
| 2007/0292231 | A1 * | 12/2007 | Boot | 411/82 |
| 2009/0191005 | A1 * | 7/2009 | Schmidt et al. | 405/259.1 |
| 2010/0278614 | A1 * | 11/2010 | Bickford | 411/417 |
| 2010/0290840 | A1 * | 11/2010 | Boot et al. | 405/259.1 |
| 2011/0262246 | A1 * | 10/2011 | Aicher | 411/418 |

* cited by examiner

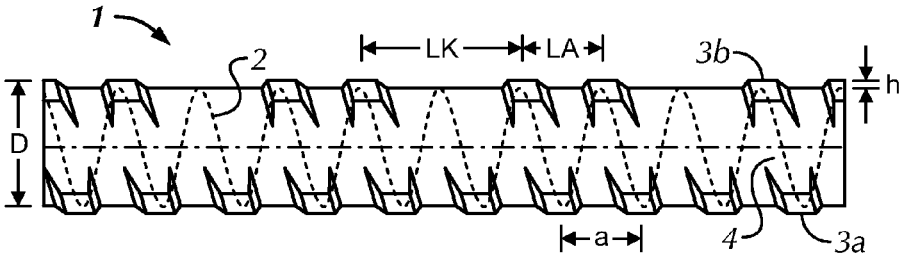
1
2
LK
LA
3b
h
D
a
4
3a

THREADED ROD

CROSS-REFERENCE TO RELATED APPLICATIONS

This application claims the benefit of German Utility Model No. DE 20 2010 006 059.1 filed Apr. 23, 2010 entitled "Threaded Rod" which is hereby incorporated by reference herein in its entirety.

BACKGROUND OF THE INVENTION

The present invention generally relates to a threaded rod.

BRIEF SUMMARY OF THE INVENTION

In one embodiment, there is a threaded rod comprising a single coarse thread having flattenings on opposite sides forming thread sections on opposite sides, wherein at least one of the thread sections on one side of the threaded rod is omitted.

In one embodiment, a number of the omitted thread sections is less than a number of remaining thread sections on the one side of the threaded rod. In one embodiment, the threaded rod has a loading capacity of at least 70 kN. In one embodiment, the threaded rod has an impact point of at least 500 $N/mm^2$. In one embodiment, the threaded rod has a tensile strength of at least 600 $N/mm^2$.

In another embodiment, a threaded rod comprises a first plurality of thread sections, and a second plurality of thread sections having a pitch distance and being threadably aligned with the first plurality of thread sections, the second plurality of thread sections each being radially spaced on each lateral side of the threaded rod from the first plurality of thread sections by a flattened section extending along an axial length of the threaded rod, wherein at least one of the first plurality of thread sections is omitted such that at least two adjacent first plurality of thread sections are spaced apart a distance equal to twice the pitch distance.

In one embodiment, the at least one omitted first plurality of thread sections are fewer in number than a number of remaining first plurality of thread sections. In one embodiment, the first plurality of thread sections includes a repeating pattern of omitted and remaining thread sections along the axial length of the threaded rod. In one embodiment, none of the second plurality of thread sections are omitted. In one embodiment, the threaded rod has a loading capacity of at least approximately 70 kN. In one embodiment, the threaded rod has an impact point of at least approximately 500 $N/mm^2$. In one embodiment, the threaded rod has a tensile strength of at least approximately 600 $N/mm^2$. In one embodiment, the threaded rod has a diameter greater than approximately 10 mm. In one embodiment, the pitch distance greater than approximately 0.5 cm.

BRIEF DESCRIPTION OF THE DRAWING

The foregoing summary, as well as the following detailed description of embodiments of the threaded rod, will be better understood when read in conjunction with the appended drawing of an exemplary embodiment. It should be understood, however, that the invention is not limited to the precise arrangements and instrumentalities shown.

In the drawing:

FIG. 1 is a side elevational view of a threaded rod in accordance with an exemplary embodiment of the present invention.

DETAILED DESCRIPTION OF THE INVENTION

Referring to the drawing in detail, there is shown in FIG. 1 a threaded rod, generally designated 1, in accordance with an exemplary embodiment of the present invention.

Threaded rods may be used, for example, in reinforcement technology, in particular formwork technology, but also in geotechnical engineering.

For this purpose, threaded rods have a high loading capacity and therefore are comprised of high-quality steel; hence, substantial costs are involved. In many fields of application, however, such a high loading capacity is not required.

It is therefore the problem of the invention to provide threaded rods 1 which are adapted to the requirements of the respective application.

According to the invention, this may be achieved, in one embodiment, by providing a threaded rod 1 that comprises a single, coarse, screw thread 2 having a pitch distance a. The rod 1 includes two diametrically opposed flattened sections 4 (only one shown) that extend through the thread 2 along an axial length of the threaded rod forming a first plurality of thread sections 3*a* diametrically opposed from a second plurality of thread sections 3*b*. One or more thread sections 3*a*, 3*b* may be omitted such that at least two adjacent first plurality of thread sections 3*a* or at least two adjacent second plurality of thread sections 3*b* are spaced apart a distance LK equal to twice the pitch distance LA or a.

In one embodiment, a threaded rod 1 comprises a first plurality of thread sections 3*b*, and a second plurality of thread sections 3*a* having a pitch distance a and having a common imaginary thread 2 with the first plurality of thread sections 3*b*. In one embodiment, the first plurality of thread sections 3*a* are threadably aligned with the second plurality of thread sections 3*b*. The second plurality of thread sections 3*a* each being radially spaced on each lateral side of the threaded rod 1 by a flattened section 4 extending along an axial length of the threaded rod 1. At least one of the first plurality of thread sections is omitted such that at least two adjacent first plurality of thread sections are spaced apart a distance equal to twice the pitch distance.

Additional advantageous embodiments of the invention are described below.

According to the invention, part of the thread sections of the thread 2 is omitted at least on one side of the rod 1. Each rod 1 is thus identified, for example as regards its loading capacity. Rods 1 for which a lower loading capacity is sufficient, for example, can therefore be manufactured from less expensive steel.

In one embodiment, the omitted thread sections of the thread 2 are on either side of the rod 1. In one embodiment, the rod 1 may have all thread sections 3*a* of the thread 2 on one longitudinal side. In this case, the identification can also consist in an omission of the thread sections 3*b* of the thread 2 on the opposite longitudinal side, that is to say there are gaps LK formed by omitted thread sections 3*b* between the existing thread sections 3*b*. For example, one or more thread sections LK may be missing after one or more thread sections 3*b* on a longitudinal side of the rod 1.

For example, a specific number of e.g. two to four thread sections 3*b* may be followed by a specific number of e.g. one to three omitted thread sections LK, with the respective number of thread sections 3*b* and the respective number of omitted thread sections LK regularly alternating along the axial length of rod 1.

Preferably, the number of the omitted thread sections LK on at least one side of the rod 1 is smaller than the number of the thread sections 3*a* on the opposite side. In one embodiment, the number of omitted thread sections LK is less than the number of remaining thread sections 3*b* on the same side of the rod 1.

In some embodiments, the diameter D of the threaded rods 1 can be approx. 10 mm to approx. 40 mm, in particular approx. 10 mm to approx. 20 mm, the height of the threads approx. 0.6 mm to approx. 4 mm and the distance of the threads from each other (i.e. pitch a) approx. 0.5 cm to approx. 2.5 cm from center to center of the ribs (without taking the omitted thread sections LK into account). In one embodiment, the diameter D of the threaded rod 1 is substantially constant along the axial length of the threaded rod 1.

Preferably, the loading capacity of the threaded rod 1 is at least approx. 70 kN, in particular approx. 80 kN. The yield point is at least approx. 500 N/mm$^2$, in particular approx. 700 N/mm$^2$ to approx. 900 N/mm$^2$, and the tensile strength is at least approx. 600 N/mm$^2$, in particular approx. 800 N/mm$^2$ to approx. 1000 N/mm$^2$.

The threaded rod 1 according to the invention can be used, for example, in all fields of application relating to formwork technology.

Due to the invention, a threaded rod 1, in particular a formwork anchor, is thus provided, which proves to be very economical especially in case of reduced workloads, particularly if concessions can be made in terms of loading capacity properties.

The threaded rod 1 according to the invention comprises a thread 2 which proves to be just as easily screwable as a conventional threaded rod with a coarse thread and flattenings on both sides, where no thread sections are omitted.

Hence, the threaded rod 1 according to the invention may be used for the same accessories as a conventional threaded rod, and may be, for example, easily screwed in the internal thread of the standard accessories of threaded rods such as a plate, a socket etc.

In addition, the threaded rod has an increased impact strength, which at −20° C. is more than approx. 20 joules, in particular more than approx. 27 joules.

By way of example, the invention is described in more detail below based on the enclosed drawing, which is a lateral view of a portion of a threaded rod 1.

Accordingly, the threaded rod 1 has a single coarse thread 2, whereas the thread 2 marked in dashed lines is formed by the thread sections 3*a*, 3*b* on opposite sides of the rod 1. A flattening 4 of the thread 2 is provided between the thread sections 3*a*, 3*b*. A further flattening of the thread 2 is on the opposite side of the flattening 4 and is not visible in the drawing. The flattenings 4 may be flush with the core of the rod 1 or intended into the core of the rod 1 such that the intersecting thread 2 is not visible between thread sections 3*a*, 3*b*. In other embodiments, the flattenings 4 may extend partially through the thread 2 so at least a portion of the thread 2 extends from the threaded rod 1 between thread sections 3*a*, 3*b* (not shown). In one embodiment, the flattenings 4 separate the thread 2 into the first plurality of thread sections 3*a* and the second plurality of thread sections 3*b*. In one embodiment, the flattenings 4 are diametrically opposed from one another. In other embodiments, the flattenings 4 are radially spaced from one another a different distance. In other embodiments, additional flattenings are provided.

In one embodiment, whereas on one longitudinal side—the lower side shown in the drawing—all thread sections 3*a* of the thread 2 exist, part of the thread sections 3*b* of the thread 2 is omitted on the upper side.

Due to the omission of a specific number of thread sections 3*b* in the longitudinal direction of the threaded rod 1, a longitudinal section LA with a specific number of e.g. two thread sections 3*b* of the thread 2 is each followed by a gap LK. The sections LA and LK may alternate, that is to say a threaded section LA is each followed by a gap LK.

In comparison, all thread sections 3*a* on the opposite side of the threaded rod 1 have the same distance a from each other. If the diameter D of the threaded rod 1 is, for example, approx. 15 mm, the distance a from center to center of the ribs of the thread sections 3*a* may be approx. 1.2 mm. In this case, the height of the ribs h is, for example, approx. 1 mm to approx. 2 mm.

It will be appreciated by those skilled in the art that changes could be made to the exemplary embodiments shown and described above without departing from the broad inventive concept thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. The words "right", "left", "lower" and "upper" designate directions in the drawings to which reference is made. The words "inwardly" and "outwardly" refer to directions toward and away from, respectively, the geometric center of threaded rod 1. Unless specifically set forth herein, the terms "a", "an" and "the" are not limited to one element but instead should be read as meaning "at least one".

I claim:

1. A threaded rod comprising:

a single coarse thread having flattenings on opposite sides of the threaded rod forming a plurality of thread sections on a first side of the threaded rod and a second side of the threaded rod opposite the first side, wherein at least one of the plurality of thread sections on the first side of the threaded rod is omitted forming at least one omitted thread section, and wherein the single coarse thread extends through the at least one omitted thread section and extends at each end through at least one of the plurality of thread sections on the second side of the threaded rod before extending through one of the plurality of thread sections on the first side.

2. The threaded rod according to claim 1, wherein a number of the at least one omitted thread sections is less than a number of remaining plurality of thread sections on the first side of the threaded rod.

3. The threaded rod according to claim 1, wherein the threaded rod has a loading capacity of at least 70 kN.

4. The threaded rod according to claim 1, wherein the threaded rod has an impact point of at least 500 N/mm$^2$.

5. The threaded rod according to claim 1, wherein the threaded rod has a tensile strength of at least 600 N/mm$^2$.

6. A threaded rod comprising:

a first plurality of thread sections; and a second plurality of thread sections having a pitch distance and being threadably aligned with the first plurality of thread sections along a single coarse thread, the second plurality of thread sections each being radially spaced on each lateral side of the threaded rod from the first plurality of thread sections by a flattened section extending along an axial length of the threaded rod, wherein at least one of the first plurality of thread sections is omitted forming at least one omitted thread section such that at least two adjacent first plurality of thread sections are spaced apart a distance equal to twice the pitch distance, and wherein the single coarse thread extends through the at least one omitted thread section and extends at each end through at least one of the second plurality of thread sections before extending through one of the first plurality of thread sections.

7. The threaded rod according to claim 6, wherein the at least one omitted first plurality of thread sections are fewer in number than a number of remaining first plurality of thread sections.

8. The threaded rod according to claim 6, wherein the first plurality of thread sections includes a repeating pattern of omitted and remaining thread sections along the axial length of the threaded rod.

9. The threaded rod according to claim 6, wherein none of the second plurality of thread sections are omitted.

10. The threaded rod according to claim 6, wherein the threaded rod has a loading capacity of at least approximately 70 kN.

11. The threaded rod according to claim 6, wherein the threaded rod has an impact point of at least approximately 500 $N/mm^2$.

12. The threaded rod according to claim 6, wherein the threaded rod has a tensile strength of at least approximately 600 $N/mm^2$.

13. The threaded rod according to claim 6, wherein the threaded rod has a diameter greater than approximately 10 mm.

14. The threaded rod according to claim 6, wherein the pitch distance is greater than approximately 0.5 cm.

15. The threaded rod according to claim 1, wherein none of the plurality of threaded sections on the second side of the threaded rod are omitted.

16. The threaded rod according to claim 1, wherein at least two of the plurality of thread sections are omitted on the first side of the threaded rod forming at least two consecutive omitted thread sections, and wherein at least two of the plurality of thread sections on the first side of the threaded rod are provided between the at least two consecutive omitted thread sections.

17. The threaded rod according to claim 6, wherein at least two of the first plurality of thread sections are omitted forming at least two consecutive omitted thread sections, and wherein at least two of the first plurality of thread sections are provided between the at least two consecutive omitted thread sections.

* * * * *